US008776308B2

(12) United States Patent
Jung et al.

(10) Patent No.: US 8,776,308 B2
(45) Date of Patent: Jul. 15, 2014

(54) CLEANER AND CONTROL METHOD THEREOF

(75) Inventors: Hyun Soo Jung, Seongnam-si (KR); Dong Won Kim, Hwaseong-si (KR); Seung Il Han, Sosa-gu (KR); Hwi Chan Jang, Suwon-si (KR); Jun Hwa Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 356 days.

(21) Appl. No.: 13/067,681

(22) Filed: Jun. 20, 2011

(65) Prior Publication Data

US 2012/0047676 A1 Mar. 1, 2012

(30) Foreign Application Priority Data

Aug. 26, 2010 (KR) ..... 10-2010-0082935

(51) Int. Cl.
*A47L 5/00* (2006.01)
*A47L 11/00* (2006.01)
*A47L 13/40* (2006.01)

(52) U.S. Cl.
USPC ..... 15/339; 15/1.51

(58) Field of Classification Search
USPC ..... 15/1.51, 4, 319, 339
See application file for complete search history.

(56) References Cited

U.S. PATENT DOCUMENTS

| | | | | |
|---|---|---|---|---|
| 4,186,030 | A * | 1/1980 | Armstrong | 134/1 |
| 4,866,565 | A * | 9/1989 | Wray, Jr. | 361/215 |
| 5,150,499 | A * | 9/1992 | Berfield | 15/327.1 |
| 7,174,593 | B2 * | 2/2007 | Soejima et al. | 15/1.51 |
| 7,591,043 | B2 * | 9/2009 | Ninomiya et al. | 15/339 |
| 2005/0166355 | A1 * | 8/2005 | Tani | 15/319 |

FOREIGN PATENT DOCUMENTS

| | | | |
|---|---|---|---|
| EP | 0293802 | A2 | 7/1988 |
| WO | WO 03/024292 | A2 | 3/2003 |

OTHER PUBLICATIONS

European Search Report Mailed Jul. 1, 2013 in corresponding European Application No. 11172781.4.

* cited by examiner

*Primary Examiner* — Dung Van Nguyen
(74) *Attorney, Agent, or Firm* — Staas & Halsey LLP

(57) ABSTRACT

A robot cleaner having a static-charge removal device to prevent deterioration in performance or damage to an interior circuit of the cleaner due to static charge. The robot cleaner includes a conductive trap member to trap frictional static charge, a discharge member electrically connected to the trap member to discharge the static charge, trapped by the trap member, into another kind of energy, for example, light, sound, or kinetic energy, and a ground member located on the robot cleaner while being connected to the discharge member. The robot cleaner prevents adherence of dust, loose debris, etc. as well as damage to an interior circuit thereof due to static charge, thereby efficiently performing a cleaning operation.

16 Claims, 8 Drawing Sheets

CLEANER AND CONTROL METHOD THEREOF

CROSS-REFERENCE TO RELATED APPLICATIONS

This application claims the priority benefit of Korean Patent Application No. 2010-0082935, filed on Aug. 26, 2010 in the Korean Intellectual Property Office, the disclosure of which is incorporated herein by reference.

BACKGROUND

1. Field

Embodiments relate to a cleaner including a static-charge removal device and a control method thereof.

2. Description of the Related Art

A robot cleaner is an apparatus to perform a cleaning operation by suctioning dust, loose debris, etc. from floors while self-traveling about a space to be cleaned without manual operation. Such a robot cleaner may be affected by static charge. Static charge is electric charge created when two objects made of different materials are rubbed together and electrons from one of the objects rub off onto the other. If static charge is generated while a robot cleaner travels, nearby dust, loose debris, etc., a positive or negative charge may be adhered to the robot cleaner by electrical attraction. More specifically, since the robot cleaner accumulates a static charge through frictional interaction between a main brush having a cleaning function and a structure surrounding the main brush and also, frictional interaction between at least one side brush and the floor, pet hair and dust may be adhered to a body of the robot cleaner. Moreover, the static charge accumulated in the robot cleaner may cause physical damage to Integrated Circuit (IC) elements of a main Printed Circuit Board (PCB) or PCB Board Assembly (PBA) that serve to control the robot cleaner.

A vacuum cleaner is used to clean houses, vehicles, or other places, and in particular, may be used to clean recessed places that are difficult to clean using brooms or other cleaning implements, and other places. Such a vacuum cleaner functions to remove dust, loose debris, etc. using strong suction generated by rotation of a motor.

Conventionally, when suctioning loose debris present on floors through a suction port, the loose debris may rub against a pipe extending from the suction port. Thus, as static charge is generated in the pipe, the loose debris may be adhered to a region around the suction port and an inner surface of the pipe, thereby contaminating the robot cleaner. The electrically-charged, suctioned loose debris may cause malfunction of a control device provided at a handle and breakage of elements. In addition, when the static charge accumulated during cleaning is discharged, the user may experience a powerful shock.

SUMMARY

Therefore, it is an aspect to provide a cleaner and a control method thereof, which may prevent malfunction and breakage of constituent elements due to static charge via removal of static charge.

Additional aspects of the invention will be set forth in part in the description which follows and, in part, will be apparent from the description, or may be learned by practice of the invention.

In accordance with one aspect, a robot cleaner including a body, a drive device, and a main brush to sweep up loose debris from a surface to be cleaned, includes at least one trap member to trap static charge, a ground member to create a potential difference in cooperation with the trap member, and a discharge member electrically connected to the trap member and the ground member and serving to discharge the trapped static charge.

The discharge member may discharge the trapped static charge into another kind of energy.

The ground member may be located in the robot cleaner.

The trap member may be installed at a portion of the body that rubs against the main brush.

The robot cleaner may further include a side brush, and the trap member may be installed at a portion of the side brush or at a portion of the body.

The trap member may include a conductive metal or an anti-static brush.

The anti-static brush may be installed at a portion of the body that rubs against the main brush.

The discharge member may discharge the trapped static charge into light, sound, kinetic energy, or any combination thereof.

The discharge member may include a lamp, a Light Emitting Diode (LED), a buzzer, or a motor.

The discharge member may serve as an indicator to inform a user of discharge of the trapped static charge via emission of light or sound, or kinetic energy.

The at least one trap member may include a plurality of trap members installed in the body.

In accordance with another aspect, a control method of a robot cleaner includes trapping frictional static charge using a conductive member, electrically connecting a ground member to the conductive member in which the static charge has been trapped, so as to create a potential difference between the ground member and the conductive member, and discharging the trapped static charge into another kind of energy, for example, light, sound, or kinetic energy.

In accordance with a further aspect, a cleaner includes a suction port through which loose debris is suctioned, an extension pipe connected to the suction port, a trap member to trap static charge, generated in the extension pipe as the suctioned loose debris rubs against the extension pipe, using a conductive member, and a control device including a discharge member electrically connected to the trap member and serving to discharge the static charge trapped by the trap member into another kind of energy, for example, light, sound, or kinetic energy, and a ground member located on the cleaner while being connected to the discharge member.

The trap member may be installed at a surface of the extension pipe where static charge is generated.

The trap member may include an antistatic brush installed at a surface of the extension pipe and serving to remove the trapped static charge.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
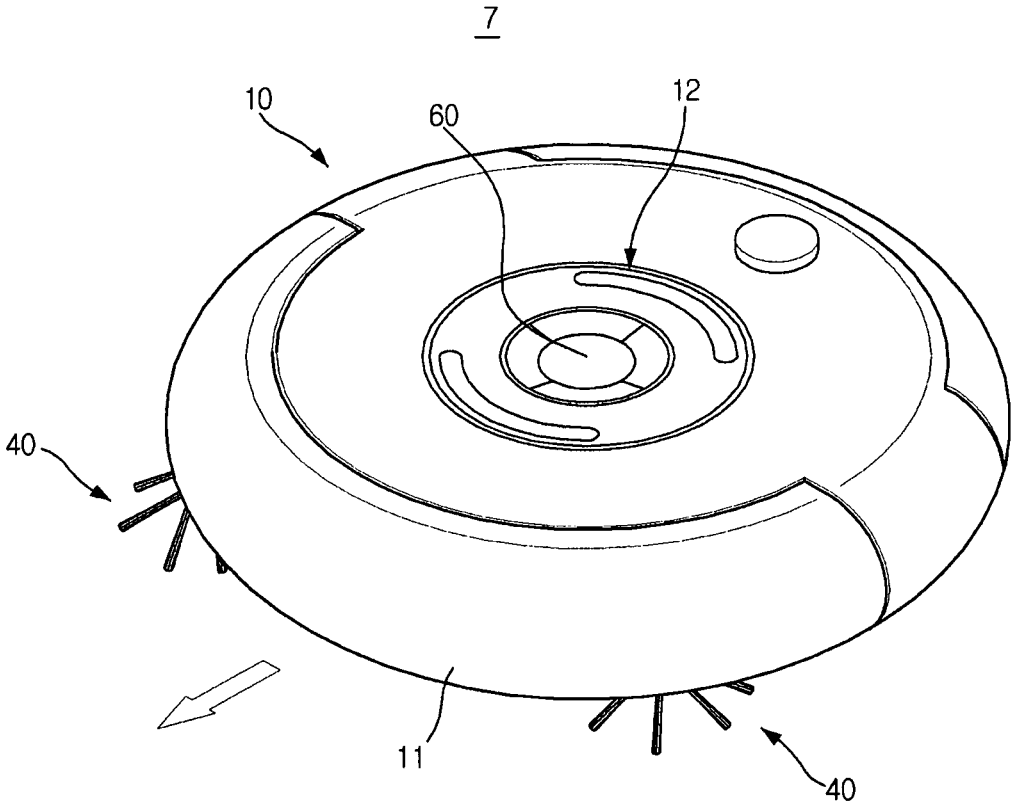
FIG. 1 is a perspective view illustrating an external appearance of a robot cleaner according to an embodiment.

Reference will now be made in detail to the embodiments, examples of which are illustrated in the accompanying drawings, wherein like reference numerals refer to like elements throughout.

Figure 2:
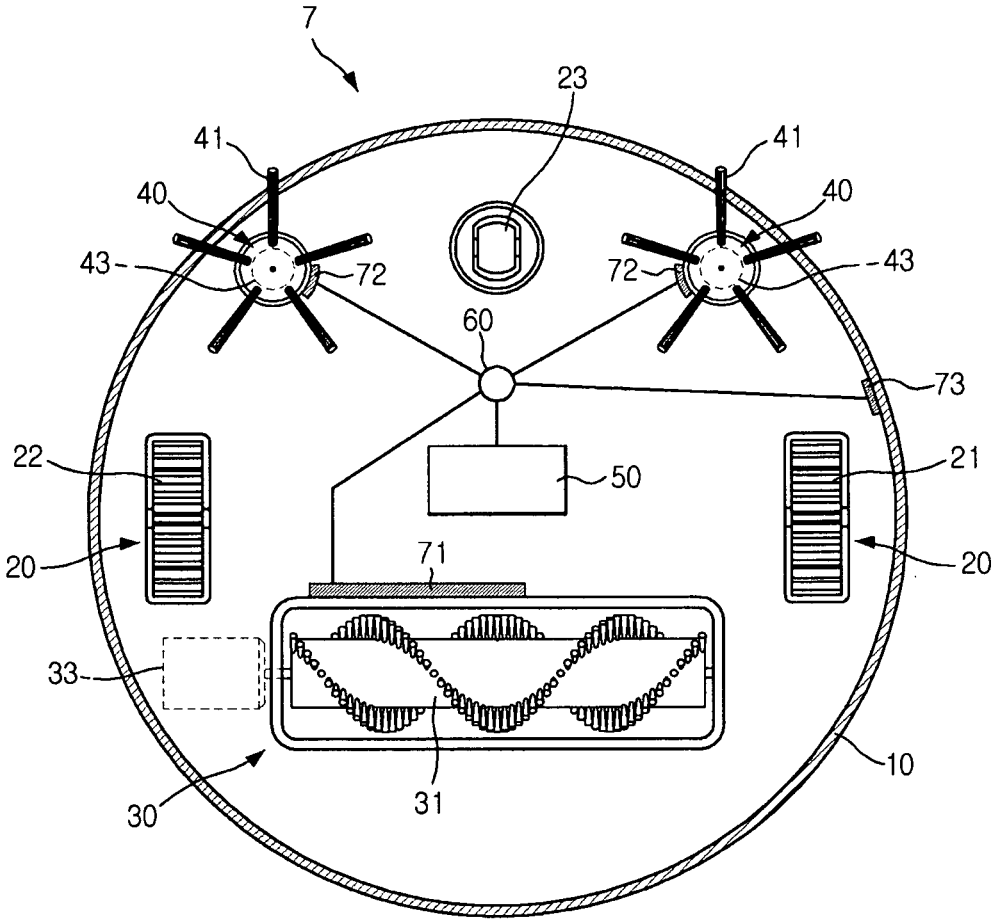
FIG. 2 is a bottom view of the robot cleaner including a static-charge removal device according to the embodiment.

FIG. 1 is a perspective view illustrating an external appearance of a robot cleaner according to an embodiment, and FIG. 2 is a bottom view of the robot cleaner including a static-charge removal device according to the embodiment.

In FIGS. 1 and 2, the robot cleaner 7 according to the embodiment includes a body 10 defining an external appearance of the robot cleaner, and a drive device 20 and a plurality of brush devices 30 and 40 provided at the bottom of the body 10, the drive device 20 serving to move the robot cleaner 7, and the plurality of brush devices 30 and 40 serving to sweep up dust and loose debris from the floor on which the robot cleaner 7 travels. Here, the embodiment deals with the robot cleaner 7 by way of example, but may be applied to all cleaners affected by static charge. For example, a static-charge removal device according to the embodiment may be applied to the robot cleaner 7, a vacuum cleaner, a cyclone cleaner, and others.

In addition to the drive device 20 and the plurality of brush devices 30 and 40, the body 10 may be provided with, e.g., a contact sensor and a proximity sensor, which may sense an obstacle. For example, a bumper 11 may be provided at a front end of the body 10 and be used to sense an obstacle, such as a wall, etc., and an infrared sensor (or an ultrasonic sensor) may be provided at the bottom of the body 10 and be used to sense an obstacle, such as stairs, etc. The body 10 may be further provided with a display device 12, which gives a user information about operation and condition of the robot cleaner 7.

The drive device 20 includes a plurality of drive wheels 21 and 22 provided at central opposite side positions of the body 10 to control movement of the robot cleaner 7, and a free wheel 23 provided at a central front position of the body 10, a rotation angle of which varies according to the condition of the floor on which the robot cleaner 7 moves. The free wheel 23 takes the form of a roller or a caster, and serves to support the robot cleaner 7 so as to guide the robot cleaner 7 to desired directions, balance the robot cleaner 7 and prevent the robot cleaner 7 from falling over.

Both the drive wheels 21 and 22 move forward or rearward based on signals from a control unit, so as to control movement of the robot cleaner 7. For example, both the drive wheels 21 and 22 may be driven forward or rearward to move the robot cleaner 7 forward or rearward. In another example, the right drive wheel 22 may be driven forward while the left drive wheel 21 is driven rearward so as to turn the robot cleaner 7 to the left, or similarly, the left drive wheel 21 may be driven forward while the right drive wheel 22 is driven rearward so as to turn the robot cleaner 7 to the right. The left and right drive wheels 21 and 22 may be driven in the opposite directions so as to turn the robot cleaner 7 to the right or to the left.

The plurality of brush devices 30 and 40 include a main brush device 30 to sweep up dust and loose debris from the floor, and a plurality of side brush devices 40 located at front opposite side positions of the bottom of the body 10.

The main brush device 30 includes a drum-shaped rotating brush 31 (hereinafter, referred to as a main brush) that is rotated in a roller manner so as to sweep up dust and loose debris from the floor, and a main brush motor 33 to rotate the main brush 31.

Each of the side brush devices 40 includes a rotating brush 41 (hereinafter, referred to as a side brush) to rotate horizontally on the floor, and a side brush motor 43 to rotate the side brush 41.

Hereinafter, the static-charge removal device of the robot cleaner 7 illustrated in FIG. 2 will be described.

The static-charge removal device included in the robot cleaner 7 serves to discharge a static charge accumulated in the robot cleaner 7. To this end, the static-charge removal device includes a plurality of trap members 70, a discharge member 60, and a ground member 50.

The plurality of trap members 70 include a conductive member containing a conductive metal. The plurality of trap members 70 are attached to the robot cleaner 7 so as to have a great contact area with any object with a static charge.

The plurality of trap members 70 may further include an antistatic brush 80. The antistatic brush 80 serves to primarily remove static charge accumulated in the robot cleaner 7 so as to enable more effective removal of static charge. To this end, the antistatic brush 80 functions as an ionizer to neutralize static charge by attaching positive or negative ions to a charged object. Of ions generated by an antistatic device installed close to a charged object, some ions having opposite polarity to the charged object are moved to and coupled with the charged object, thereby acting to remove static charge. Antistatic devices may be classified into voltage-application type, self-discharge type, and radiation type antistatic devices according to ion producing methods. The antistatic brush 80 according to the embodiment may be any one of the aforementioned types.

Figure 3:
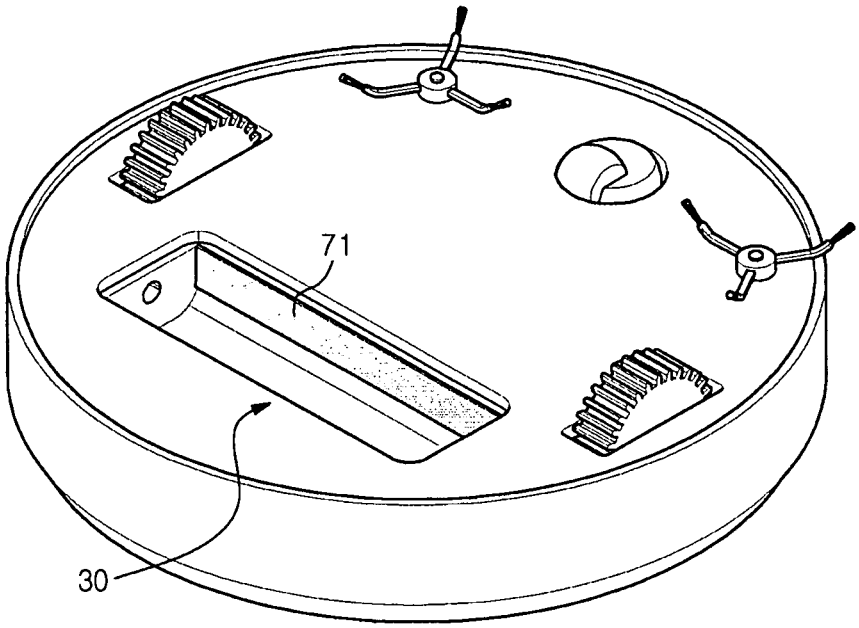
FIG. 3 is a perspective view illustrating a conductive member located at a main brush device of the robot cleaner according to the embodiment.
Figure 4:
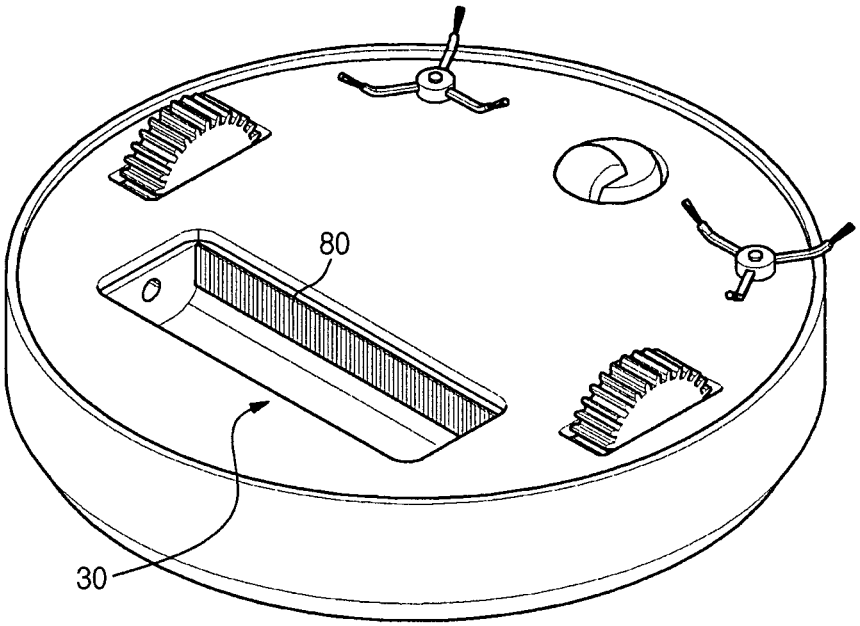
FIG. 4 is a perspective view illustrating an antistatic brush located at the main brush device of the robot cleaner according to the embodiment.
Figure 5:
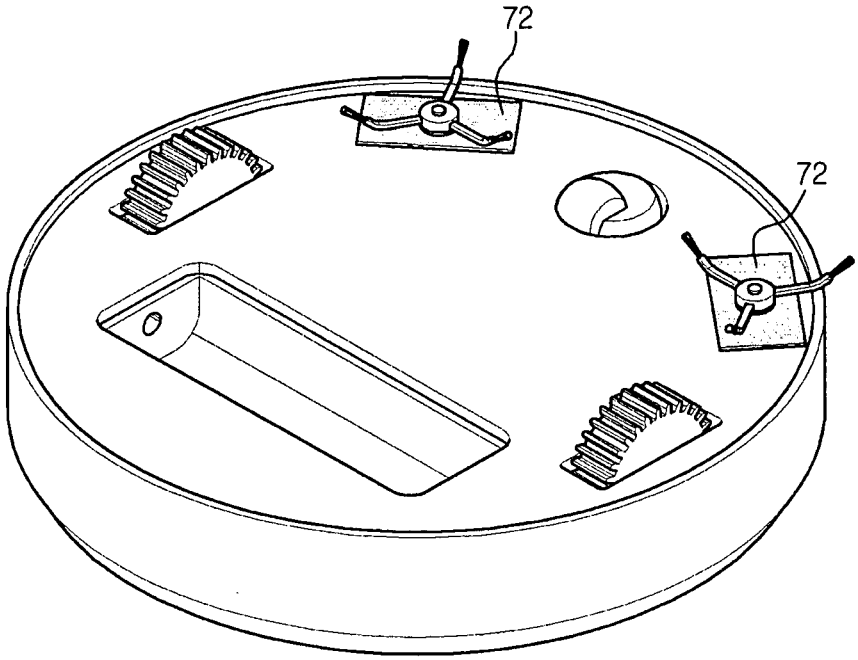
FIG. 5 is a perspective view illustrating a conductive member located at a side brush device of the robot cleaner according to the embodiment.

The plurality of trap members 70 are installed at static charge generating places of the robot cleaner 7. Referring to FIG. 3, the plurality of trap members 70 may include a conductive main brush trap member 71 installed at the main brush device 30. Specifically, the main brush trap member 71 may be provided at a portion of the body 10 that rubs against the main brush 31. Referring to FIG. 4, the antistatic brush 80 is installed at the main brush device 30. Similarly, the antistatic brush 80 is installed at a portion of the body 10 that rubs against the main brush 31. Referring to FIG. 5, the side brush device 40 may be provided with a conductive side brush trap member 72 that is included in the plurality of trap members 70. Specifically, the side brush trap member 72 is installed at a portion of the side brush device 40 that rubs against the floor. In addition, a body trap member 73 is installed at a portion of the body 10 that rubs against nearby objects.

The aforementioned plurality of trap members 71 to 73 may have different shapes according to the shape of an installation place thereof. For example, referring to FIG. 3, a portion of the body 10, to which the main brush trap member 71 is attached, defines a curved surface on which the main brush 31 is rubbed while rotating. Thus, the main brush trap member 71 may have a curved shape and may be attached to the curved surface of the body 10. In another example, referring to FIG. 5, a portion of the side brush device 40, to which the side brush trap member 72 is attached, may have an approximately circular shape. Thus, the side brush trap member 72 may have a circular flat plate shape and may be attached to a portion of the body 10 to which the side brush device 40 is connected. In a further example, the body trap member 73 may be connected to a surface of the robot cleaner 7 that often rubs against nearby objects. Thus, the body trap member 73 may define a part of the surface of the robot cleaner 7 and may be attached to the surface of the robot cleaner 7.

Referring to FIG. 4, the antistatic brush 80 may have a shape similar to that of the main brush trap member 71 and may be installed close to the main brush 31. Specifically, the antistatic brush 80 may be installed at the installation position of the main brush trap member 71, i.e. at the portion of the body 10 that rubs against the main brush 31. In addition, the antistatic brush 80 may be installed at the installation position of the side brush trap member 72, i.e. at the portion of the side brush 41 that rubs against the floor, and also, may be installed at the installation position of the body trap member 73, i.e. at the portion of the body 10 that rubs against nearby objects. When providing the antistatic brush 80, after the trap member 70 primarily removes static charge generated in the robot cleaner 7, the antistatic brush 80 installed adjacent to the trap member 70 may more effectively remove static charge.

The plurality of trap members 70 are electrically connected to the discharge member 60, and include the main brush trap member 71, the side brush trap member 72, and the body trap member 73. The plurality of trap members 70 may be additionally provided at other static charge generating places of the robot cleaner 7. The plurality of trap members 70 serve to trap static charge generated in the robot cleaner 7. The main brush trap member 71 traps static charge generated when the main brush 31 of the main brush device 30 rubs against the body 10 of the robot cleaner 7 during operation thereof. The side brush trap member 72 traps static charge generated when the side brush 41 of the side brush device 40 rubs against the floor during operation thereof. The body trap member 73 traps static charge generated when the robot cleaner 7 rubs against nearby objects during traveling thereof.

Figure 6:
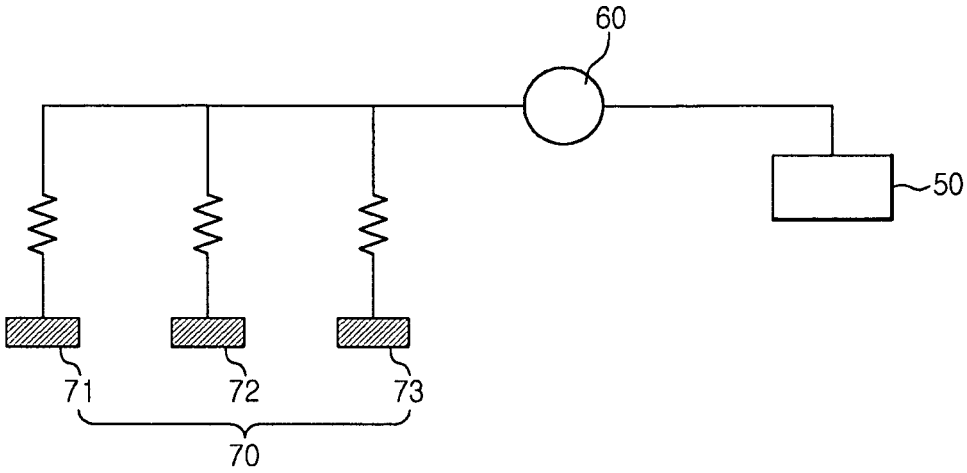
FIG. 6 is a circuit diagram illustrating the static-charge removal device of the robot cleaner according to the embodiment.

The discharge member 60 is electrically connected to the ground member 50 and the plurality of trap members 70. The circuit diagram of FIG. 6 illustrates the static-charge removal device included in the robot cleaner 7 according to the embodiment. The static-charge removal device of the robot cleaner 7 includes the ground member 50, the discharge member 60, and the plurality of trap members 70. The ground member 50 is electrically connected to the discharge member 60 via an electric wire, a resistor, or the like, and in turn, the discharge member 60 is electrically connected to the plurality of trap members 70 via electric wires, resistors, or the like.

The discharge member 60 serves to discharge static charge in the form of specific energy. To this end, the discharge member 60 functions to convert static charge into another kind of energy, for example, light, sound, kinetic energy, or any combination thereof. The discharge member 60 includes a lamp or a Light Emitting Diode (LED), which converts static charge into light to discharge the light. The lamp is a device to generate light using electric power, and is selected from among a neon lamp, a fluorescent lamp, and others. The discharge member 60 may also include a buzzer, a motor, or the like. The buzzer serves to convert static charge into sound to discharge the sound, and the motor serves to convert static charge into kinetic energy to discharge the kinetic energy. The motor may include an electric motor.

The discharge member 60 may be installed on the robot cleaner 7. If the lamp or LED included in the discharge member 60 is located at an outer surface of the body 10 of the robot cleaner 7, it may be possible to visually inform the user of removal of static charge by the static charge removal device as the lamp included in the discharge member 60 converts static charge into light and thereby discharging the light.

Also, it may be possible to aurally inform the user of removal of static charge by the static charge removal device as the buzzer included in the discharge member 60 converts static charge into sound and thereby discharging the sound.

Figure 7:
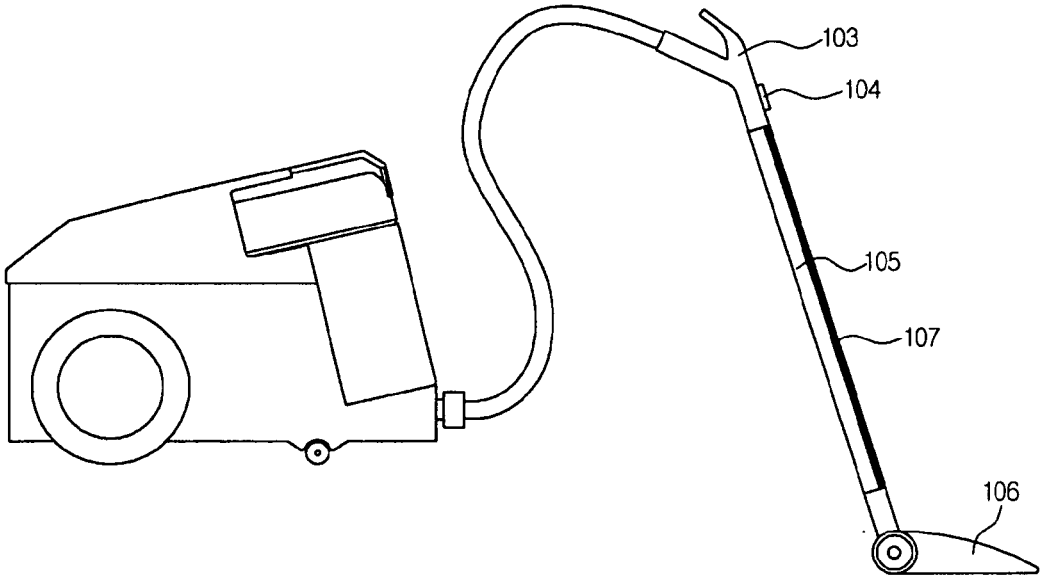
FIG. 7 is a perspective view illustrating an external appearance of a vacuum cleaner according to another embodiment.

FIG. 7 is a perspective view illustrating an external appearance of a vacuum cleaner according to another embodiment.

In the case of the vacuum cleaner 103, when loose debris present on the floor is suctioned through a suction port 106, the suctioned loose debris rubs against an extension pipe 105, causing the extension pipe 105 to be charged with static charge. Thereby, the loose debris is adhered to a narrowed portion of the suction port 106 or the extension pipe 105. To remove static charge, the vacuum cleaner 103 includes a control device 104 and a static-charge trap member 107 located at the extension pipe 105. In the case of the vacuum cleaner 103, the suction port 106 connected to the extension pipe 105 also serves to remove static charge. To realize removal of static charge, the control device 104 includes the discharge member 60 and the ground member having zero potential. The discharge member 60 included in the control device 104 electrically connects the static-charge trap member 107 and the ground member, and generates a potential difference therebetween, thereby discharging static charge in the form of specific energy.

Figure 8:
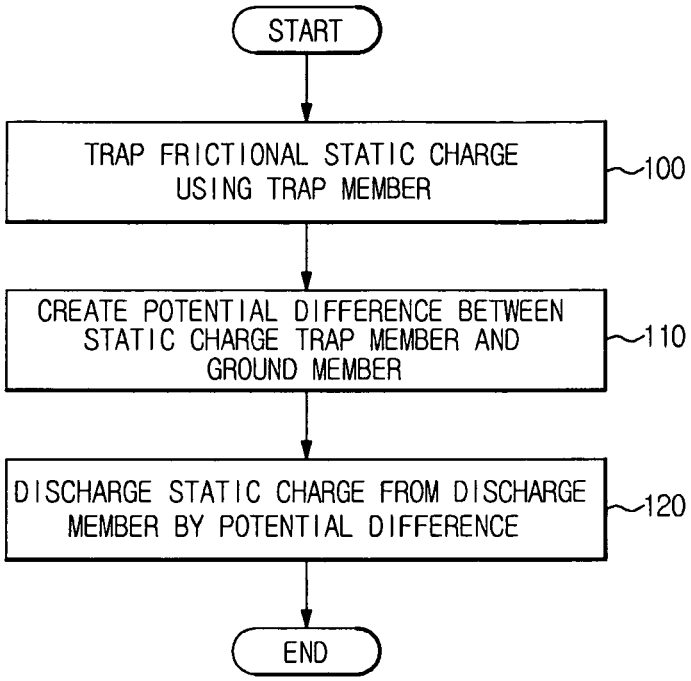
FIG. 8 is a flow chart illustrating a static-charge removal operation according to an embodiment.

FIG. 8 is a flow chart illustrating a static-charge removal operation according to an embodiment.

The plurality of trap members 70 trap static charge generated by frictional interaction at operation 100.

The plurality of trap members 70 may include the main brush trap member 71, the side brush trap member 72, the body trap member 73, and others installed at other places of the robot cleaner 7 to trap static charge generated in the robot cleaner 7. Specifically, the plurality of trap members 70 may trap static charge to prevent the static charge from being discharged to other parts of the body 10 or an interior circuit of the robot cleaner 7.

A potential difference is created between the plurality of trap members 70 used to trap static charge and the ground member 50 at operation 110.

The plurality of trap members 70, used to trap static charge, have a relatively high potential, whereas the ground member 50 has zero potential. The discharge member 60 electrically connects the plurality of trap members 70 having a high potential and the ground member 50 having zero potential, thereby constituting an electric circuit having a potential difference.

The discharge member 60 discharges static charge owing to the potential difference at operation 120.

If the discharge member 60 electrically connects the plurality of trap members 70 having a high potential and the ground member 50 having zero potential to each other, an electric circuit having a potential difference is created. Thereby, voltage is applied to the discharge member 60, causing the discharge member 60 to convert static charge into another kind of energy, for example, light, sound or kinetic energy, upon receiving the voltage.

If the lamp or LED included in the discharge member 60 converts static charge into light, it may be possible to visually inform the user of the occurrence of discharge of static charge generated in the robot cleaner 7 via emission of light. Accordingly, the discharge member 60 serves as an indicator to inform discharge of static charge from the robot cleaner 7.

Also, if the buzzer included in the discharge member 60 converts static charge into sound, it may be possible to aurally inform the user of the occurrence of discharge of static charge generated in the robot cleaner 7 via emission of sound. Accordingly, the discharge member 60 serves as an indicator to inform discharge static charge from the robot cleaner 7.

As is apparent from the above description, according to the embodiment, by removing static charge from a cleaner, it may be possible to prevent loose debris or pet hair from being adhered to the cleaner during cleaning. Further, it may be possible to prevent physical damage to an interior circuit of the robot cleaner due to static charge.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A robot cleaner including a body, a drive device, and a main brush to sweep up loose debris from a surface to be cleaned, comprising:

at least one trap member to trap static charge;

a ground member to create a potential difference in cooperation with the trap member; and a discharge member electrically connected to the trap member and the ground member, the discharge member discharging the trapped static charge into another kind of energy, the another kind of energy including at least one of light, sound and kinetic energy.

2. The robot cleaner according to claim 1, wherein the ground member is located in the robot cleaner.

3. The robot cleaner according to claim 1, wherein the trap member is installed at a portion of the body that rubs against the main brush.

4. The robot cleaner according to claim 1, further comprising a side brush, wherein the trap member is installed at any one of a portion of the side brush or a portion of the body.

5. The robot cleaner according to claim 1, wherein the trap member includes any one of a conductive metal or an anti-static brush.

6. The robot cleaner according to claim 5, wherein the anti-static brush is installed at a portion of the body that rubs against the main brush.

7. The robot cleaner according to claim 1, wherein the discharge member discharges the trapped static charge into light.

8. The robot cleaner according to claim 7, wherein the discharge member includes any one of a lamp or a Light Emitting Diode (LED).

9. The robot cleaner according to claim 7, wherein the discharge member serves as an indicator to inform a user of discharge of the trapped static charge via emission of light.

10. The robot cleaner according to claim 1, wherein the at least one trap member includes a plurality of trap members installed in the body.

11. The robot cleaner according to claim 1, wherein the discharge member discharges the trapped static charge as sound energy, the discharge member including a buzzer.

12. The robot cleaner according to claim 1, wherein the discharge member discharges the trapped static charge as kinetic energy, the discharge member including a motor.

13. A control method of a robot cleaner comprising:

trapping frictional static charge using a conductive member;

electrically connecting a ground member to the conductive member in which the static charge has been trapped, so as to create a potential difference between the ground member and the conductive member; and discharging the trapped static charge into another kind of energy, the another kind of energy including at least one of light, sound and kinetic energy.

14. A cleaner comprising:

a suction port through which loose debris is suctioned;

an extension pipe connected to the suction port;

a trap member to trap static charge, generated in the extension pipe as the suctioned loose debris rubs against the extension pipe, using a conductive member; and a control device including a discharge member electrically connected to the trap member and serving to discharge the static charge trapped by the trap member into another kind of energy, the another kind of energy including at least one of light, sound and kinetic energy, and a ground member located on the cleaner while being connected to the discharge member.

15. The cleaner according to claim 14, wherein the trap member is installed at a surface of the extension pipe where static charge is generated.

16. The cleaner according to claim 15, wherein the trap member includes an antistatic brush installed at a surface of the extension pipe and serving to remove the trapped static charge.

* * * * *

UNITED STATES PATENT AND TRADEMARK OFFICE

CERTIFICATE OF CORRECTION

PATENT NO. : 8,776,308 B2
APPLICATION NO. : 13/067681
DATED : July 15, 2014
INVENTOR(S) : Hyun Soo Jung et al.

It is certified that error appears in the above-identified patent and that said Letters Patent is hereby corrected as shown below:

In the Claims

Column 7, Line 22, In Claim 1, after “up” delete “loose”.

Column 8, Line 29, In Claim 14, after “which” delete “loose”.

Column 8, Line 32, In Claim 14, after “suctioned” delete “loose”.

Signed and Sealed this
Twenty-eighth Day of October, 2014

Michelle K. Lee

Michelle K. Lee
*Deputy Director of the United States Patent and Trademark Office*